US010619352B1

(12) United States Patent
McConnell

(10) Patent No.: US 10,619,352 B1
(45) Date of Patent: Apr. 14, 2020

(54) RAIN GUTTER FOR TIN ROOF OR THE LIKE

(71) Applicant: Terry McConnell, Norwich, NY (US)

(72) Inventor: Terry McConnell, Norwich, NY (US)

( * ) Notice: Subject to any disclaimer, the term of this patent is extended or adjusted under 35 U.S.C. 154(b) by 0 days.

(21) Appl. No.: 16/228,096

(22) Filed: Dec. 20, 2018

(51) Int. Cl.
*E04D 13/00* (2006.01)
*E04D 13/072* (2006.01)
*E04D 13/064* (2006.01)

(52) U.S. Cl.
CPC ..... *E04D 13/0725* (2013.01); *E04D 13/0641* (2013.01)

(58) Field of Classification Search
None
See application file for complete search history.

(56) References Cited

U.S. PATENT DOCUMENTS 406,233 A 7/1889 Phelps
836,012 A * 11/1906 Cassen ..... E04D 13/0725 52/12
3,080,682 A 3/1963 Teutsch
3,388,555 A * 6/1968 Foster ..... E04D 13/076 405/119
4,506,479 A 3/1985 Matthison-Hansen
4,858,396 A * 8/1989 Rose ..... E04D 13/064 52/11
5,072,551 A * 12/1991 Manoogian, Jr. ..... E04D 13/076 210/232
5,245,800 A * 9/1993 Davenport ..... E04D 13/0641 52/11
6,041,556 A 3/2000 Keller
6,594,956 B1 * 7/2003 Willing ..... E04D 13/076 248/48.2
6,688,945 B2 2/2004 Pilcher
6,988,335 B2 1/2006 Eyers
7,743,561 B1 6/2010 Frederick
7,946,081 B1 * 5/2011 Frederick ..... E04D 13/064 248/48.1
8,832,999 B1 9/2014 Bell et al.
9,765,525 B2 9/2017 Harcrow, Jr.
2016/0376790 A1 * 12/2016 Yildiz ..... E04D 13/076 52/12
2017/0058530 A1 * 3/2017 Ward ..... E04D 13/0765

* cited by examiner

*Primary Examiner* — Basil S Katcheves
(74) *Attorney, Agent, or Firm* — Bernhard P. Molldrem, Jr.

(57) ABSTRACT

An elongated rain gutter member is formed with a G-shape profile, and having an eave flange that fits between an edge of roofing material and the roof support beneath it, a generally vertical soffit portion extending down from the eave flange, and a curved rain channel member that curves outwardly and up forming a rainwater channel with the soffit portion, and continuing up and over the edge of the roofing material. A hemmed edge of the free edge portion of the curved rain channel member is fastened to the roofing material and is spaced so as to form channels into the rain gutter between the edge portion and the roofing material. This rain gutter can be used on a tin roof that has elongated ribs or can be adapted to use with a shingle roof or other roof.

13 Claims, 4 Drawing Sheets

RAIN GUTTER FOR TIN ROOF OR THE LIKE

BACKGROUND OF THE INVENTION

This invention relates to rain gutters of the type that capture the rain falling on a roof that flows down to the eave of the roof, and is more particularly concerned with a sheet metal rain gutter that can be effectively employed on the eave of a tin roof, as well as roofs covered with other types of roofing material. The invention is also concerned with rain gutters which can be fastened directly onto the roof at the eave without additional brackets and without requiring the eave to have a fascia board at the eave.

A need has long existed for a convenient, simple rain gutter system that can be employed with so-called tin roof installations, that is, roofs in which the roofing material is sheet metal and which may have vertical ribs, such as ribs that extend from the eave to the ridge or top of the roof, and which are spaced laterally at some interval. Typically the ribs are about ¾ inch high and spaced about 9 inches apart, although this spacing is not critical. Few existing rain gutter designs can be easily installed on a roof of this type, and these typically require special bracketing and need openings for rainwater punched or drilled into them. The rain gutters should also have a cover that keeps leaves, pine needles and other debris from falling into the rainwater channel of the gutter and clogging the gutters, and should have a simple way of attaching down spouts and a simple way of closing off the ends of the rain gutter members.

OBJECTS AND SUMMARY OF THE INVENTION

Accordingly it is an object of this invention to provide a convenient and simple to install rain gutter system that is well suited for installation on a tin roof, as well as other types of roof, and which avoids drawbacks of existing rain gutter installations and systems.

It is a more particular object to provide a rain gutter that is unitarily formed of a strip of sheet metal to have an eave portion that fits between the eave edge of the roofing material, a soffit portion that extends vertically down to a bend where it continues in a curved rain channel member that also serves as a cover, and with a free edge that attaches to the roofing material, e.g., to the ribs of the tin roof, leaving a space or channel for the rain to enter between the free edge and the roofing material.

It is another object to provide a rain gutter of this type that does not need openings in the cover, nor screens installed for preventing leaves or debris from entering the rain gutter.

A further object is to provide the rain gutter elements as members having a G-shaped profile or a D-shaped profile that provides simple and durable construction and which is attractive in design.

In accordance with one aspect of this invention, a rain gutter of the type described herein and which is suitably adapted for installation on a tin roof or the like is comprised of at least one elongated gutter member adapted to fit along an eave edge of a roof that is formed of a roofing material applied onto a roof support. The elongated gutter member favorably having a G-profile cross-section, in which a flat flange portion is adapted to fit between the eave edge of the roofing material and the roof support beneath it; a substantially vertical soffit portion extends downward from an edge of the flat flange portion; a curved rain channel member, forming both the rain channel (with the soffit portion) and a cover, extends from a lower edge of soffit portion and curves up and back so that a free edge portion extends above eave edge of the roofing material. The free edge then lies against the upper surface of said roofing material, but leaves open passageways between the free edge and the roofing material for rain to flow into the curved rain channel member and into the rain channel. Rivets, nails, or other fastener members hold the free edge portion of said channel member fast against the roofing material.

Where the roof is a tin roof (and the roofing material is sheet metal formed with ribs that are a predetermined height and spacing and extend from eave to ridge) the flat flange portion fits beneath the eave edge of the sheet metal, and the said free edge of the curved rain channel member is fastened to each of said ribs, favorably using rivets passing through the free edge and into respective ones of the ribs of the sheet metal roof.

Where the roof is of other roofing materials, e.g., shingles or slate, a sheet metal or other eve strip can be used, having a plurality of ribs thereon spaced apart at intervals in a horizontal direction; and each rib extending in a direction from the eave towards the ridge of the roof. The flange portion of the elongated gutter member can slide beneath this eve strip, and the free edge of the curved rain channel member thereof can be attached, e.g., by rivets, sheet metal screws, etc., to the respective ribs.

End caps, which can have a D-profile or the profile of a quadrant or other sector or partly curved-edge, partly straight-edged shape, fit into the ends of the rain gutter member(s). Down spout fittings can be secured at or near one or both ends with suitable openings cut in the rain gutter member at that or those locations. The down spouts or Down spout fittings have a curved geometry where they fit against the curved portion of the rain gutter These and many other objects, features, and advantages of the rain gutter of this invention will become apparent from the ensuing detailed description of a preferred embodiment, when read in conjunction with the accompanying Drawing.

DETAILED DESCRIPTION OF THE PREFERRED EMBODIMENT(S)

Figure 1:
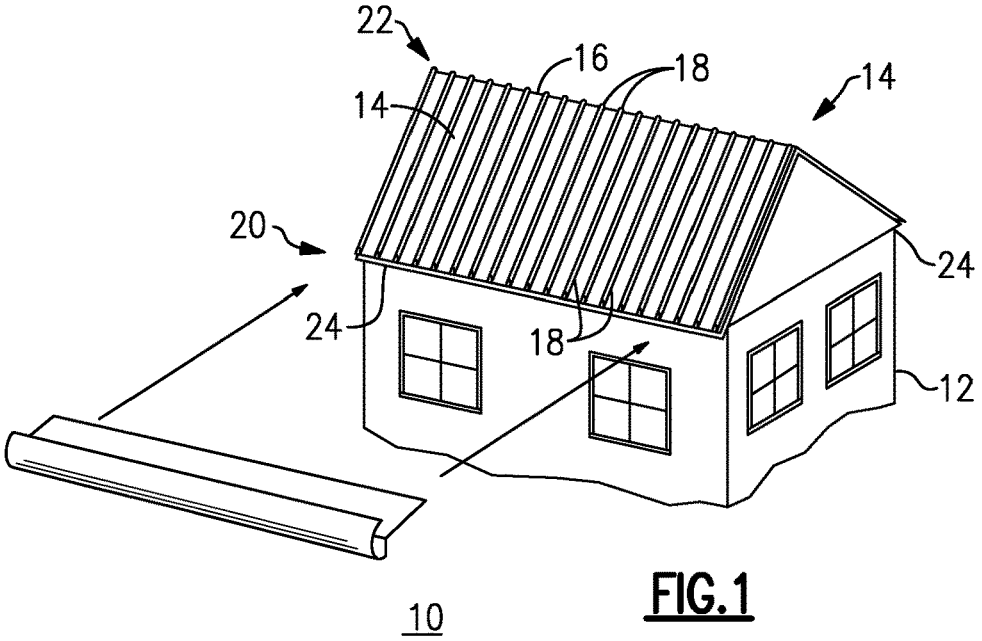
FIG. 1 is a perspective view of a building with tin roof, and an elongated rain gutter member to be installed on the eave thereof.
Figure 2:
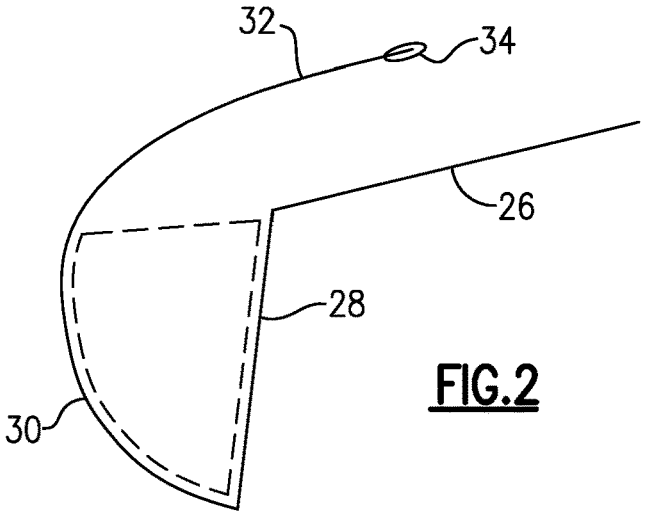
FIG. 2 is a cross section of the rain gutter member of this embodiment.
Figure 3:
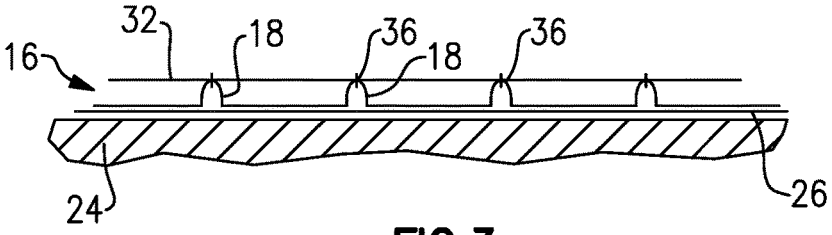
FIG. 3 is a side sectional view of the building eave showing the placement of the eave portion and free end portion of the rain gutter member of this embodiment.

With reference to the Drawing, and initially to FIGS. 1 to 3, an elongated rain gutter member 10 embodying the present invention is shown to be installed in connection with a roof of a dwelling or other building 12, the building having a tin roof 14, that is a sheet metal roof formed of sheet metal members 16 as the roofing material, and with ribs 18 thereon at intervals, spaced left to right, and extending from an eave 20 of the roof 14 to a roof ridge 22. The roof 14 is supported on a roof support 24, such as a wooden frame, in known fashion. As can be seen in FIG. 2, the rain gutter member 10 can have a profile that resembles the capital letter "G", and thus can be mounted onto an existing tin roof of this type without special tools and without the need for brackets, and can be installed on roofs with or without fascia boards or fascia plates.

In this example, the rain gutter member 10 has an eave flange 26 that is to be installed between the sheet metal roofing material 16 and the roof support 24 at the eave 20 or lower edge of the roof. This can be installed using roofing nails or can be installed using screws or other fasteners. The eave flange 26 is pitched upward an amount appropriate for the pitch of the roof to match the roof pitch. Here the eave flange has a width of about 3½ inches from its distal edge to a bend where it meets a soffit portion 28. The soffit portion extends vertically down, here about 4½ inches to a bottom edge where a bend joins it to a curved rain channel portion 30. The soffit portion can be placed directly against a fascia board, if present, and may optionally be nailed or screwed to the fascia board. The fascia board is not necessary.

The curved rain channel portion 30 extends upward and outward from the lower edge of the soffit portion 28, curving over a length of about seven to nine inches, which distance is not critical. A free edge portion 32 at the upper, distal part of the curved rain channel portion extends over an eave end of the roofing material 16 so as to extend over the eave portion of the ribs 18. This free edge portion may be the final two inches of the rain gutter member. At its distal edge, the final half-inch is bent over and turned under to form a seam 34, i.e., a double-thickness smooth edge.

Figure 6:
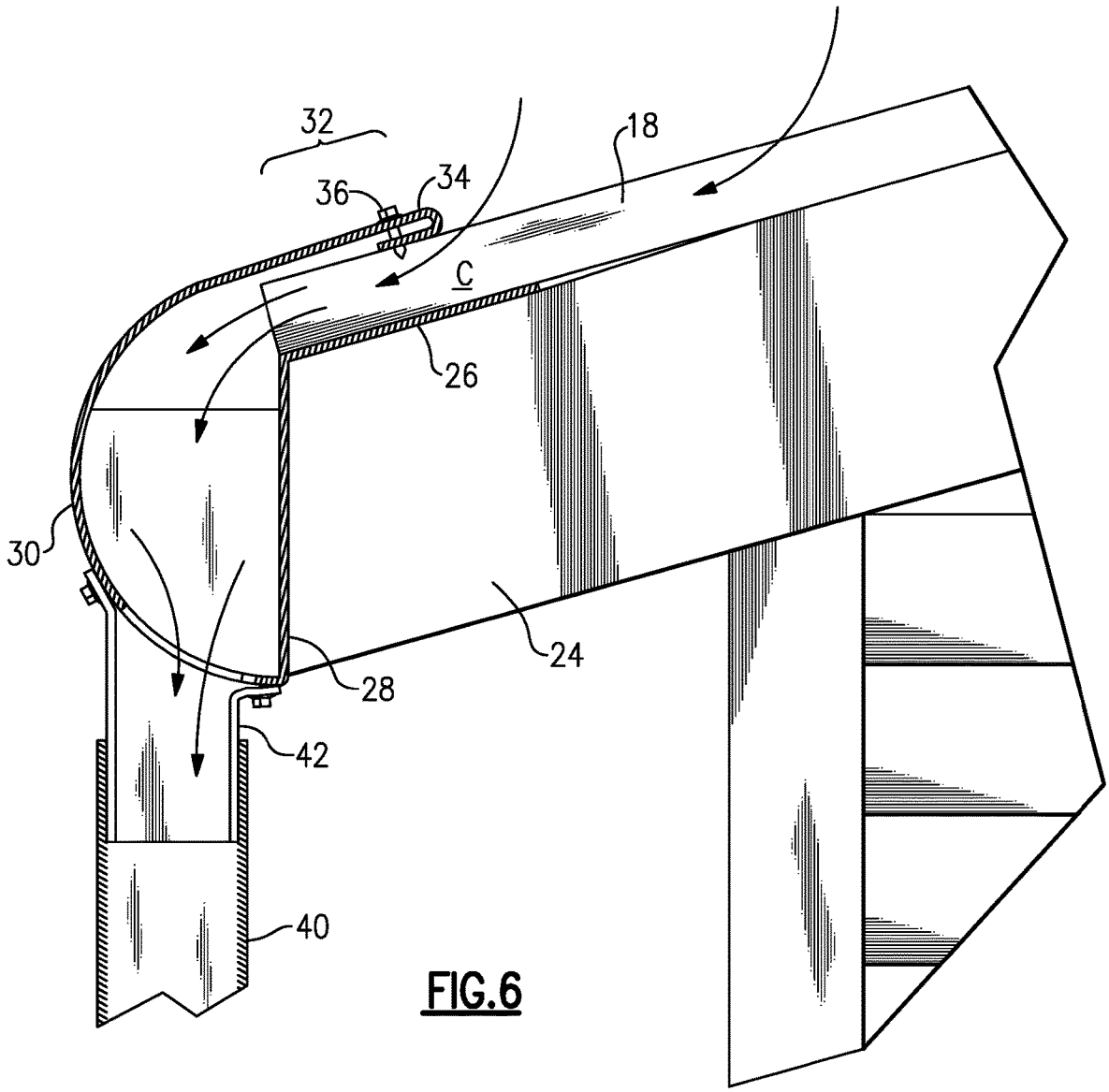
FIG. 6 is a cross section taken at 6-6 of FIG. 4.

As seen in FIG. 3, the rain gutter member is installed such that the eave flange 26 is sandwiched between the roof support 24 and the sheet metal roofing material 16, where it may be secured using standard fasteners such as roofing nails. The free edge 32 and seam 34 lie atop the upper crests of the ridges 18, to which they may be secured using rivets 36, 36 as shown here, or using other fasteners such as sheet metal screws. Ideally, the fasteners pass through the seam 34 and into the respective ribs 18, so that there is a spacing or rain channel C (see FIG. 6) defined between the free edge 32 and the roofing sheet metal 16 to allow the water that runs down the roof to enter the space defined between the rain channel portion 30 and the vertical soffit portion 28. This space has a wedge shape with one straight vertical side and one convex curved side.

Figure 4:
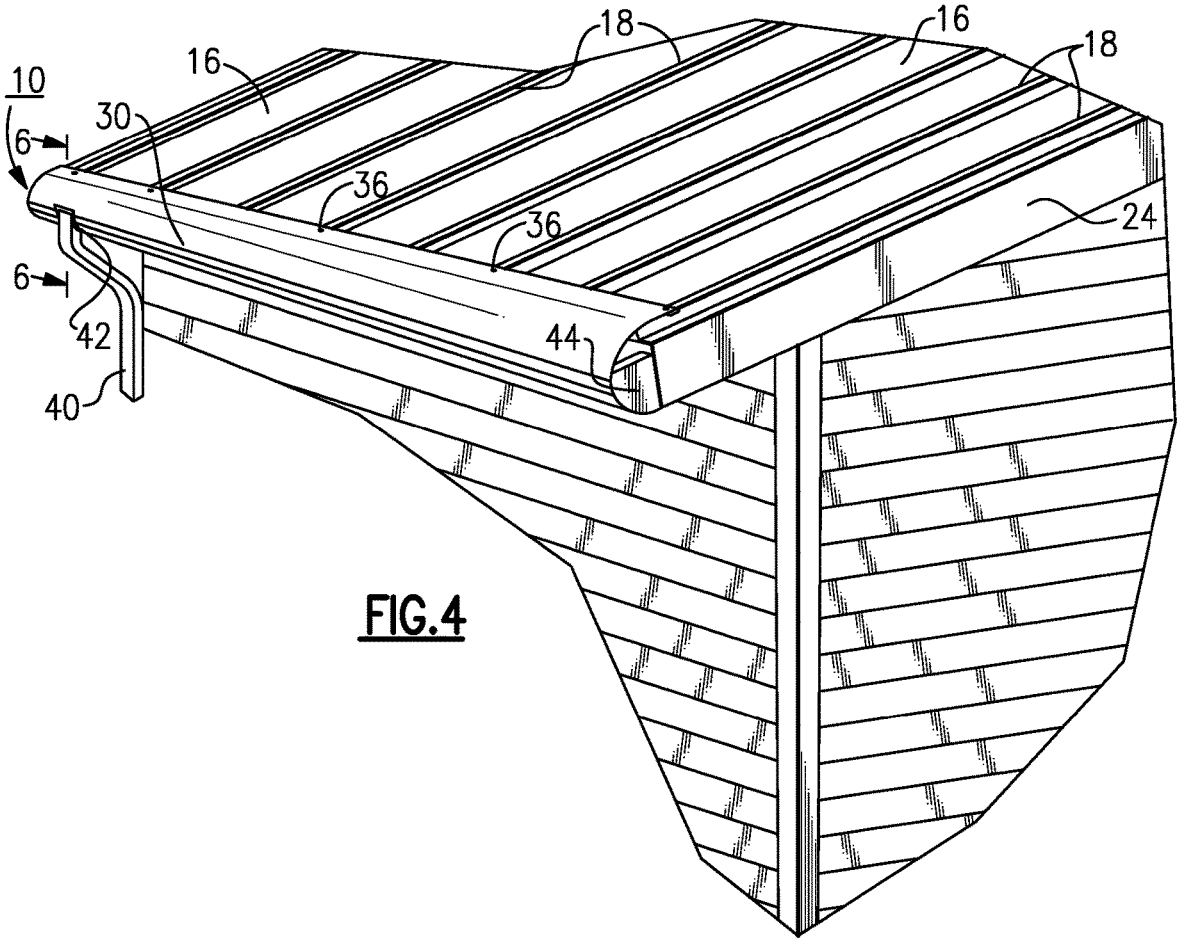
FIG. 4 is a perspective of the rain gutter member installed on the building roof eave.

The rain gutter member 10 can be given a predetermined slope from one end to the other so that rainwater flows toward a down spout 40 at one end thereof, for example, as shown in FIG. 4. The Down spout 40 may be formed of a square profile metal or plastic tubing and secured into a Down spout fitting (better shown in FIGS. 6 and 7) at some point along the length of the rain gutter member, here at one end. As shown, the fitting 42 may be secured onto an opening made in the curved portion 30. An end cap 44 may be positioned at each end to close off the ends of the rain gutter member 10. Here the end cap has a geometry to match the shape of the bottom part of the space defined by the two portions 28 and 30. This can be considered a D-shape or the lower half of a D-shape, or approximately a circular quadrant, with a flat horizontal top, a vertical side and a convex curved side. This can made of metal, hard rubber, or plastic, and can be secured to the end of the rain gutter member using sheet metal screws, cement of other technique. Auxiliary components, e.g., outside corner pieces, inside corner pieces, and altered components are within the gambit of the invention and are included in the patent.

Figure 7:
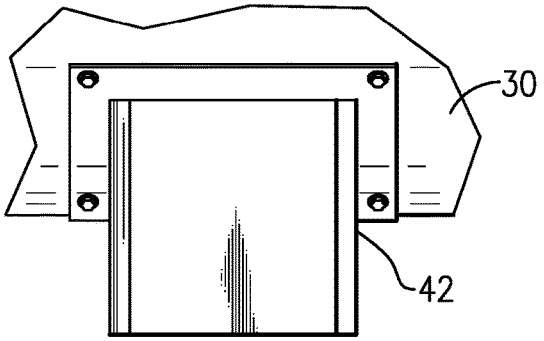
FIG. 7 is a front view of a rain gutter Down spout fitting employed in this embodiment.

Details of the rain gutter member 10 as attached to the roof support 24 and the ribs 18 are shown in FIG. 7, tracking also the path of the rain water into the spaces between ribs, and through the rainwater channels C formed between the sheet metal roof material and the free end 32 of the rain gutter member 10, and into the rainwater channel formed between the curved and flat portions 28, 30 thereof, and out the down spout fitting 42 and down spout tube 40. The fitting 42 is curved to match the curvature of the rain gutter member, and is affixed to it by known means, e.g., sheet metal screws, with a sealant to block any leakage.

Figure 8:
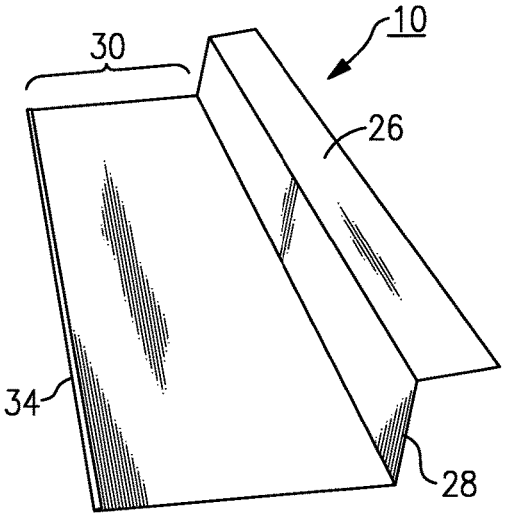
FIG. 8 is a perspective view of a blank of the rain gutter member before installation.
Figure 5:
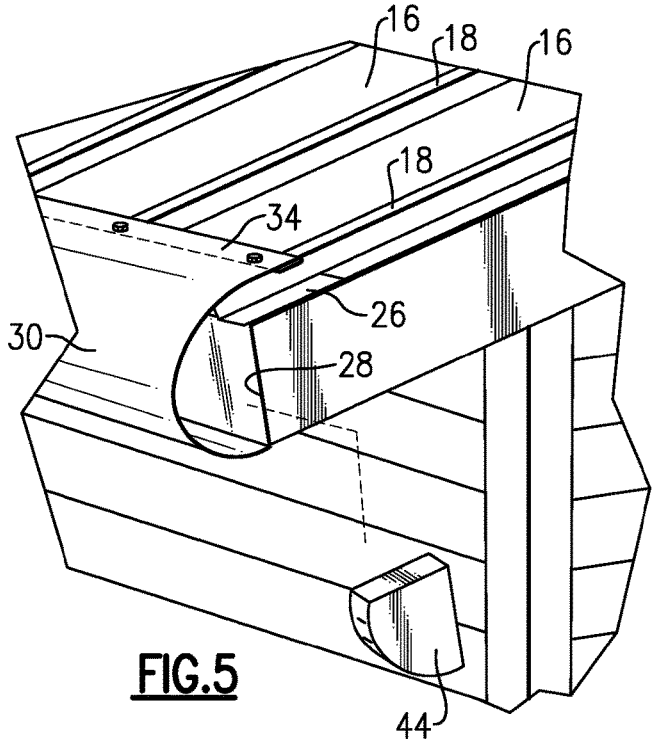
FIG. 5 is an enlarged portion of the rain gutter member shown in FIG. 4.

FIG. 8 is a perspective of a rain gutter blank prior to installation, in which the sharp bends between the eave portion 26 and soffit portion 28 and between the soffit portion 28 and the rain channel portion 30 have been pre-formed, but the curvature has not yet been formed into the rain channel portion. This shape facilitates stacking and shipping the rain gutters before bringing them to the job site. The curvature is made on-site at installation, and the rain channel portion is gently rolled up and the hem 34 affixed to the roofing to form the shape as illustrated in the previous views. Alternatively, the curvature may be put in at the factory or otherwise prior to installation.

Figure 9:
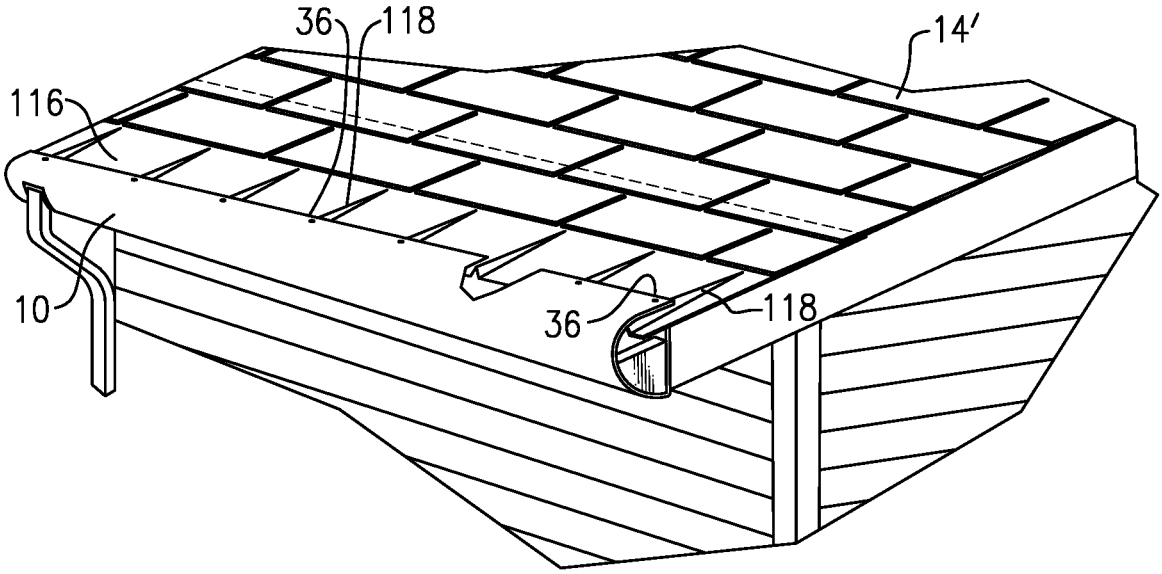
FIG. 9 is an example of the rain gutter member employed with a roof of an alternative embodiment.
Figure 10:
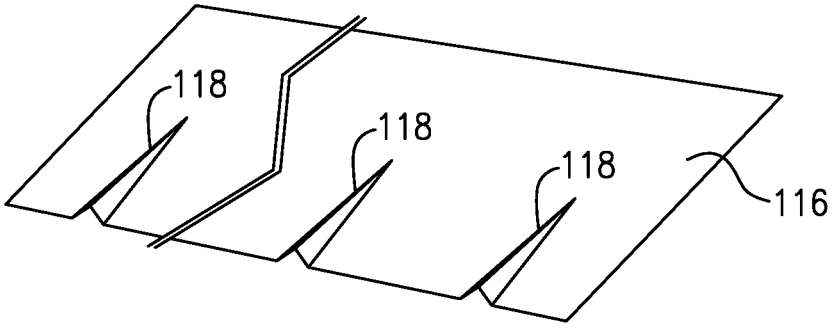
FIG. 10 is a perspective view of an eave strip employed in this embodiment.

FIGS. 9 and 10 illustrate a variant of the installation described above, where the D-shaped or G-shaped rain gutter is installed on a different roof, here a roof 14' of traditional shingles that are arranged in rows overlap one another from the eave to the ridge of the roof. In this example, a sheet metal strip 116 is installed as the first row of the roofing material, overlapped by the first row of roofing shingles. As shown in FIG. 10 the strip 116 has a plurality of ribs 118 formed in it a regular intervals in the lateral direction. These ribs serve as spacers to create the spaces where the rain water can enter the rain gutter, in the same fashion as in the embodiment described before. In this case the eave portion 26 of the rain gutter fits beneath the strip 116 and the seam 34 at the free edge of the curved rain channel member 30 is fastened onto the row of ribs 118 using suitable fasteners. As an alternative, the strip 116 can be formed of a material other than a sheet metal, e.g., a sheet of a suitable rigid or semi-rigid plastic resin or composite material.

As an alternative to metal, the G-shaped rain gutter can be made, e.g., extruded, of a durable rigid or semi-rigid plastic resin or composite. In some cases an optional heater wire may be present for prevention of winter frost damage or icicle formation. Also, the geometry of the G-shaped rain gutter can be adjusted so that there is a slope from one end to the other so that rain water drains towards the drain spout location.

The rain gutter of this invention does not require any holes to be manufactured into it or drilled into it for admitting the rainwater, as the rain enters through the channels formed between the roofing material and the free edge of the rain gutter channel member 30. This facilitates installation and allows the gutter to provide its own solid unperforated cover to keep out debris such as leaves and needles. Openings optionally may be provided, for example, for inspection purposes. Cleaning of debris, when necessary, may be effected by taking off one or more of the end caps 44 and flushing the rain gutter with a garden hose.

The invention is not limited to the foregoing embodiments, and many modifications and variations are possible without departing from the main concept. Rather the scope of this invention is defined in the appended claims.

What is claimed is:

1. A rain gutter for a roof comprising at least one elongated gutter member adapted to fit along an eave edge of a roof that is formed of a roofing material applied onto a roof support, the roofing material having an upper surface and an eave edge; the elongated gutter member including in cross-section:

a flat flange portion that is adapted to fit between the eave edge of the roofing material and the roof support beneath said eave edge;

a substantially vertical soffit portion that extends downward from an edge of said flat flange portion;

a curved rain channel member extending from a lower edge of said soffit portion and curving up and back therefrom and having a free edge portion that extends above said eave edge of said roofing material so as to lie against the upper surface of said roofing material; and a plurality of fasteners holding fast the free edge portion of said rain channel member against said roofing material and configured to leave an open passageway between the free edge of said curved rain channel member and said roofing material.

2. The rain gutter according to claim 1, wherein said elongated gutter member has a generally G-shaped profile.

3. The rain gutter according to claim 1, wherein said roof is a tin roof and said roofing material is sheet metal formed with ribs that are a predetermined height and spacing and extend from eave to ridge, and said free end of said curved rain channel member is fastened to each of said ribs.

4. The rain gutter according to claim 1, further comprising a D shaped cap attached at least at one end of said curved rain channel member.

5. The rain gutter according to claim 1, further comprising an end cap formed with a profile that is generally a sector of a circle.

6. The rain gutter according to claim 1, wherein said roof comprises an eave strip having a plurality of ribs thereon spaced apart at intervals in a horizontal direction and each said rib extending in a direction from the eave towards the ridge of said roof.

7. The rain gutter according to claim 6, wherein said fasteners are rivets inserted through said free edge portion of the rain channel member and into an associated one of said plurality of ribs.

8. The rain gutter according to claim 1, wherein said free edge portion of said rain channel member includes a hem.

9. The rain gutter according to claim 8, wherein said hem is formed of a folded-over portion of said free edge portion.

10. The rain gutter according to claim 1, wherein said elongated rain gutter member is formed of a plastic resin.

11. The rain gutter according to claim 10, wherein said plastic resin is a rigid or semi-rigid plastic resin.

12. The rain gutter according to claim 10, wherein said plastic resin is a composite.

13. The rain gutter according to claim 1, wherein said elongated rain gutter member extends from one end thereof to another end thereof, and is formed with a geometry that permits the rain gutter member when installed on an eave of a roof to slope from said one end towards the other end thereof.

* * * * *